US012208492B2

(12) United States Patent
Eckel et al.

(10) Patent No.: US 12,208,492 B2
(45) Date of Patent: Jan. 28, 2025

(54) REPOSITIONABLE ABRASIVE DISC MOUNTING ASSEMBLY AND METHOD OF USING THE SAME

(71) Applicant: 3M INNOVATIVE PROPERTIES COMPANY, St. Paul, MN (US)

(72) Inventors: Joseph B. Eckel, Vadnais Heights, MN (US); Thomas J. Nelson, Woodbury, MN (US); Fay T. Salmon, Eden Prairie, MN (US); David T. Buckley, Falcon Heights, MN (US); Cory M. Arthur, Eagan, MN (US); Alireza Ghaderi, Woodbury, MN (US); Dominic J. Triana, Minneapolis, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 222 days.

(21) Appl. No.: 17/784,869

(22) PCT Filed: Dec. 10, 2020

(86) PCT No.: PCT/IB2020/061785

§ 371 (c)(1),
(2) Date: Jun. 13, 2022

(87) PCT Pub. No.: WO2021/124036

PCT Pub. Date: Jun. 24, 2021

(65) Prior Publication Data

US 2023/0008040 A1 Jan. 12, 2023

Related U.S. Application Data

(60) Provisional application No. 62/949,321, filed on Dec. 17, 2019.

(51) Int. Cl.
*B24D 9/08* (2006.01)
*B24B 45/00* (2006.01)

(52) U.S. Cl.
CPC ..... *B24D 9/085* (2013.01); *B24B 45/006* (2013.01)

(58) Field of Classification Search
CPC ..... B24B 23/02; B24B 23/022; B24B 23/028; B24B 41/04; B24B 41/047; B24B 45/00;
(Continued)

(56) References Cited

U.S. PATENT DOCUMENTS 2,990,661 A 7/1961 Hackett
4,245,438 A * 1/1981 van Buren, Jr. ..... B24D 9/085 15/49.1

(Continued)

FOREIGN PATENT DOCUMENTS

DE 102010043190 A1 5/2012

OTHER PUBLICATIONS

Gfycat, "Retractable Pen (Click Pen): How it works GIF", Oct. 1, 2017, YouTube, URL: <https://gfycat.com/thornyjealousasianlion>, 1 page.

(Continued)

*Primary Examiner* — Robert F Neibaur

(57) ABSTRACT

A repositionable abrasive disc mounting assembly comprises a backup pad and a clamp assembly. The backup pad has a rotational axis of use and a major surface with projections extending outwardly therefrom. The backup pad further comprises an inwardly facing centrally disposed first fastening member, and also an outwardly facing centrally disposed second fastening member. The clamp assembly comprises inner and outer clamp members for securing an abrasive disc. The inner clamp member comprises an inwardly facing centrally disposed third fastening member (Continued)

adapted to repositionably engage the second fastening member in a discrete number of rotational orientations. The inner clamp member further comprises an outwardly facing centrally disposed fourth fastening member. The outer clamp member comprises an inwardly facing centrally disposed fifth fastening member adapted to securely engage the fourth fastening member. A method of abrading a workpiece using the repositionable abrasive disc is also disclosed.

10 Claims, 6 Drawing Sheets

(58) Field of Classification Search
CPC ..... B24B 45/003; B24B 45/006; B24D 5/16; B24D 7/16; B24D 9/08; B24D 9/085; B24D 13/14; B24D 13/20; B24D 2201/00
USPC ..... 451/359, 458, 490, 508, 509, 510, 522, 451/538, 539, 548
See application file for complete search history.

(56) References Cited

U.S. PATENT DOCUMENTS 4,683,683 A * 8/1987 Block ..... B24D 9/085 451/521
4,839,998 A * 6/1989 Block ..... B24D 9/085 451/509
6,116,996 A * 9/2000 Yanase ..... B24B 23/02 451/508
7,189,152 B1 * 3/2007 Ohata ..... B24D 7/16 451/521
8,997,618 B1 * 4/2015 Majcen ..... B24B 45/006 83/698.41
9,656,360 B2 * 5/2017 Multhammer ..... B23Q 3/15706
2003/0096566 A1 * 5/2003 Fritz ..... B24B 45/006 451/508
2018/0339400 A1 * 11/2018 Park ..... B24B 23/022

OTHER PUBLICATIONS

International Search Report for PCT Application No. PCT/IB2020/061785, mailed on Apr. 9, 2021, 4 pages.
Plymouth Products, "Phenolic Plates", Retrieved on Apr. 30, 2020, URL: <https://www.plymouthproducts.com/phenolicplatessavadisc.htm>, 1 page.
Product Literature: Factory Supply Outlet, "3M Disc Pad Face Plate (1EA/CA)", 2020, 4 pages.
Product Literature: 3M 81734, Gordon Electric Supply, "Disc Pad Face Plate Rib 5M", 2020, 3 pages.

* cited by examiner

REPOSITIONABLE ABRASIVE DISC MOUNTING ASSEMBLY AND METHOD OF USING THE SAME

CROSS-REFERENCE TO RELATED APPLICATIONS

This application is a national stage filing under 35 U.S.C. 371 of PCT/IB2020/061785, filed Dec. 10, 2020, which claims the benefit of U.S. Provisional Application Ser. No. 62/949,321, filed Dec. 17, 2019.

TECHNICAL FIELD

The present disclosure broadly relates to abrasive discs, apparatus for use in conjunction with abrasive discs, and methods of using the same.

BACKGROUND

Abrasive fiber discs typically have an abrasive layer on a vulcanized fiber backing. In one common use, an abrasive fiber disc having a central arbor hole is mounted to a backup pad that is driven by a rotating power shaft of an angle grinder. The backup pad allows the operator to exert pressure toward a workpiece being abraded while mitigating any deformation of the disc. Some such backup pads have raised ridges that can increase pressure against adjacent portions of the disc, resulting in increased abrading rate. However, uneven wear of the abrasive disc may result, and the disc may be discarded with some portions of the abrasive layer still in usable condition.

SUMMARY

It is presently discovered that rotationally repositioning an abrasive fiber disc after a period of use so that worn areas of the abrasive layer are no longer adjacent to the ribs of the backup pad, and lesser worn areas are placed adjacent to the ribs, can substantially extend the useful life of the abrasive fiber disc, thereby reducing cost to the user and reducing waste.

In one aspect, the present disclosure provides a repositionable abrasive disc mounting assembly comprising:

a backup pad having a rotational axis of use and a major surface with projections extending outwardly therefrom, wherein the backup pad further comprises an inwardly facing centrally disposed first fastening member for securing the backup pad to a drive shaft of a power tool, and wherein the backup pad further comprises an outwardly facing centrally disposed second fastening member; and a clamp assembly for securing the abrasive disc, the clamp assembly comprising inner and outer clamp members, wherein the inner clamp member comprises an inwardly facing centrally disposed third fastening member adapted to repositionably engage the second fastening member in a discrete number of rotational orientations around the rotational axis of use, and wherein the inner clamp member further comprises an outwardly facing centrally disposed fourth fastening member, and wherein the outer clamp member comprises an inwardly facing centrally disposed fifth fastening member adapted to securely engage the fourth fastening member.

In another aspect, the present disclosure provides a method of abrading a workpiece, the method comprising the steps:

a) providing an abrasive disc secured to a backup pad mounted on a drive shaft of a power tool, wherein the backup pad has outwardly facing projections capable to contacting the abrasive disc when abrading the workpiece;

b) abrading the workpiece with the abrasive disc whereby more worn and less worn regions of the abrasive disc are formed;

c) repositioning the abrasive disc relative to the backup pad such that the projections of the backup pad are predominantly rotationally aligned with the less worn regions; and d) abrading at least one of the same or a different workpiece.

In some embodiments, the backup pad is part of a repositionable abrasive disc mounting assembly according to the present disclosure.

As used herein:

the term "inwardly facing" means that it is at least inwardly facing, but may also be outwardly facing in addition; and the term "outwardly facing" means that it is at least inwardly facing, but may also be inwardly facing in addition;

the term "more worn" means a region having more apparent wear than adjacent regions; and the term "less worn" refers to a region having less apparent wear (also including no wear) than adjacent regions.

Features and advantages of the present disclosure will be further understood upon consideration of the drawings and detailed description as well as the appended claims.

Figure 1:
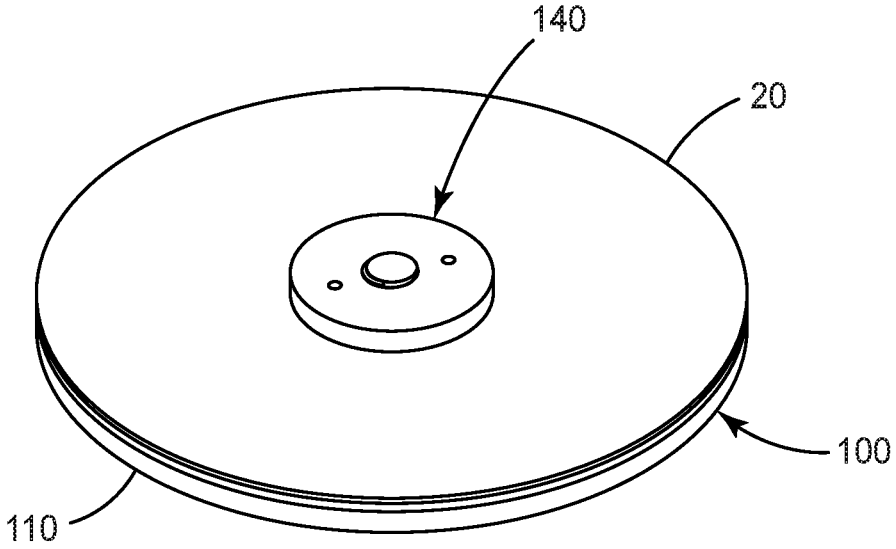
FIG. 1 is a schematic perspective view of repositionable abrasive disc mounting assembly 100 retaining an abrasive disc and mounted on a drive shaft of a power tool.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Many configurations of the repositionable abrasive disc mounting assembly are possible, depending, for example, on the particular clamp and fastener configurations.

In the embodiments below, it will be recognized that the various fastening members can be one half of any suitable reclosable fastening devices including, for example, a friction-fit fastener, a threaded shaft or post coupled with a threaded bore or nut; a spring-ball locking fasteners (snap-on fasteners); or a bayonet mount. Likewise, projections from the backup pads may have any shape, including, for example, arcuate ribs, spokes, islands, or posts.

Components of the repositionable abrasive disc mounting assembly should be made of appropriately durable materials. Examples include engineering plastics (e.g., nylons, polyphenylene sulfide, polyether ketone, polyether ether ketone, polycarbonate, high density polyethylene, high density polypropylene), polymer composites, metals, ceramic composites, and combinations thereof.

Figure 2:
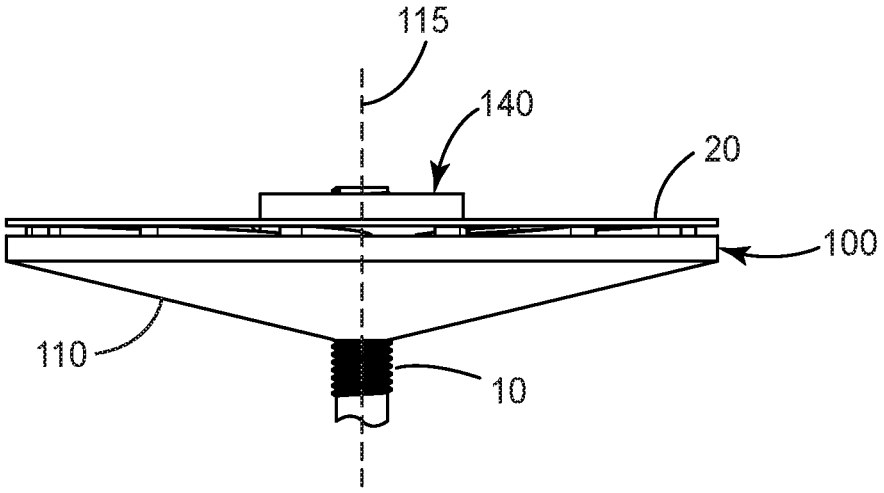
FIG. 2 is a schematic side view of repositionable abrasive disc mounting assembly 100 retaining an abrasive disc and mounted on a drive shaft of a power tool.

Referring now to FIGS. 1 and 2, repositionable abrasive disc mounting assembly 100 comprises a backup pad 110 and a clamp assembly 140 that secures an abrasive disc 20. Repositionable abrasive disc mounting assembly 100 includes an outwardly facing centrally disposed fastening member 130 (shown as a threaded bore, see FIG. 4) that is adapted to engage a threaded drive shaft 10 of a power tool (not shown) such as, for example, an angle grinder. The backup pad 110 has ribbed projections 118 (see FIG. 3) that provide added support to abrasive disc 20. During abrading of a workpiece, the drive shaft 10 rotates around a rotational axis of use (115). Over time, the abrasive disc may typically experience uneven disc wear. If that occurs, the clamp assembly may be unfastened from backup pad 110 and repositioned in a discrete orientation such that the ribbed projections 118 are beneath portions of the abrasive disc that have less wear. The clamp assembly is then re-secured to the backup member before continuing to abrade the workpiece.

Figure 3:
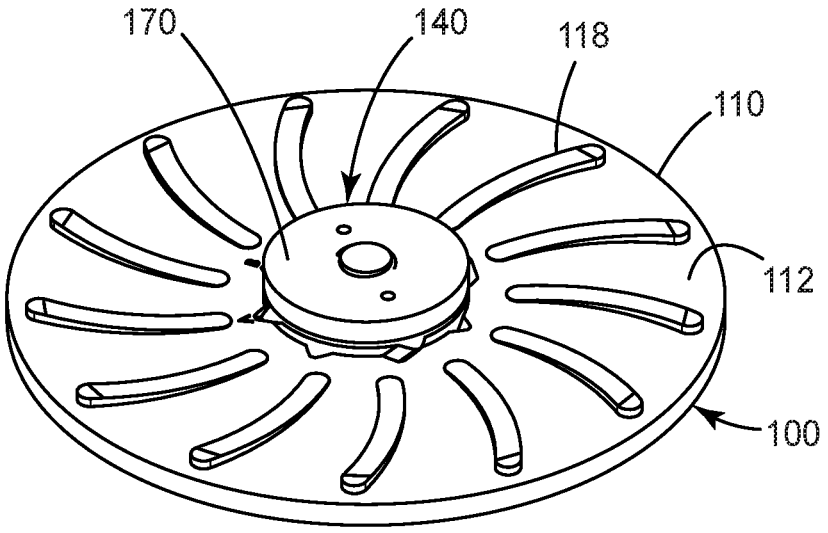
FIG. 3 is a schematic perspective view of repositionable abrasive disc mounting assembly 100.
Figure 4:
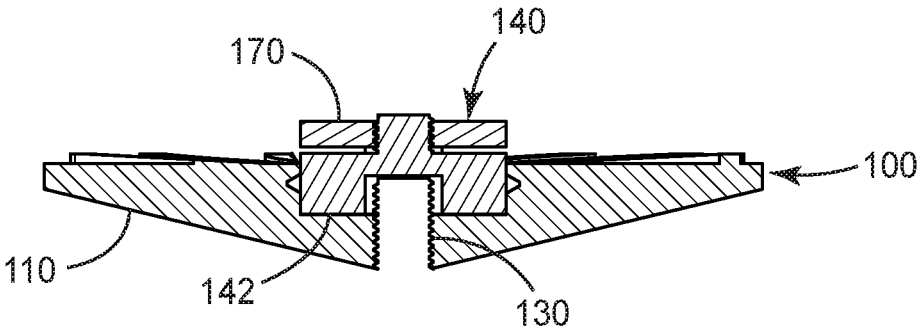
FIG. 4 is a schematic side view of repositionable abrasive disc mounting assembly 100.
Figure 5:
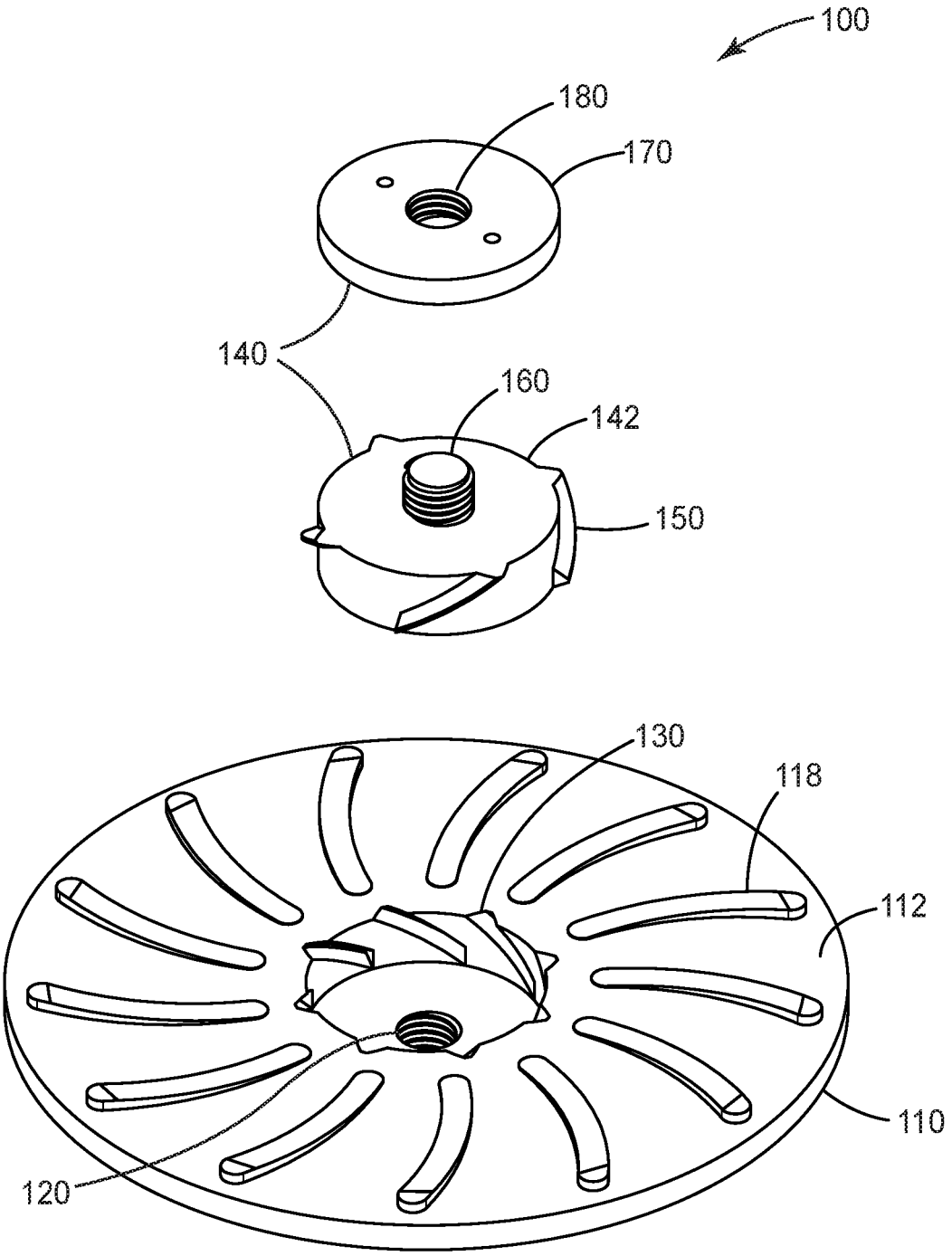
FIG. 5 is a schematic exploded perspective view of repositionable abrasive disc mounting assembly 100.

FIGS. 3-5 further show the repositionable abrasive disc mounting assembly 100 in isolation without an accompanying abrasive disc and threaded drive shaft.

Referring now to FIG. 5, repositionable abrasive disc mounting assembly 100 comprises a backup pad 110. Backup pad 110 has a rotational axis of use (see 115 in FIG. 2) and a major surface 112 with ribbed projections 118 extending outwardly therefrom. Backup pad 110 comprises an inwardly facing centrally disposed first fastening member 120 (shown as a threaded bore) for securing the backup pad 110 to a drive shaft of a power tool (see 10 in FIG. 2). Backup pad 110 further comprises an outwardly facing centrally disposed second fastening member 130 (shown as helical grooves).

Clamp assembly 140 comprises inner and outer clamp members (142, 170).

Inner clamp member 142 comprises an inwardly facing centrally disposed third fastening member 150 (shown as helical ribs) adapted to repositionably engage the second fastening member 130. While the third fastening member is shown as ribs and the second fastening member is shown as grooves, it is contemplated that the opposite configuration may also be used. The spacing and pitch of the helical grooves provides discrete rotational orientations at which the clamp assembly can be secured. Inner clamp member 142 further comprises an outwardly facing centrally disposed fourth fastening member 160 (shown as a threaded post).

Outer clamp member 170 comprises an inwardly facing centrally disposed fifth fastening member 180 (shown as a threaded bore) adapted to securely engage the threaded post 160. In this configuration, the helical grooves and ribs are preferably aligned such that they tighten as the disc turns in use. The clamp assembly is disengaged from the backup pad by a simple twisting motion, and can then be rotated to a new orientation and reengaged with the backup pad.

Figure 6:
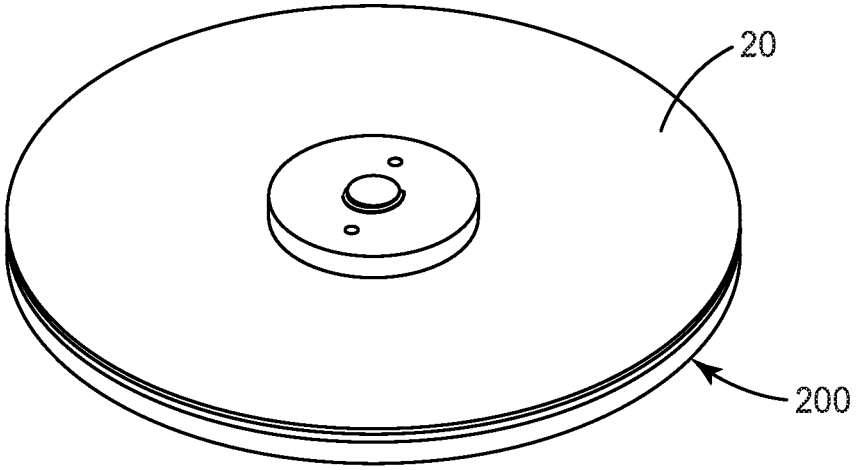
FIG. 6 is a schematic perspective view of exemplary repositionable abrasive disc mounting assembly 200 retaining an abrasive disc and mounted on a drive shaft of a power tool.
Figure 7:
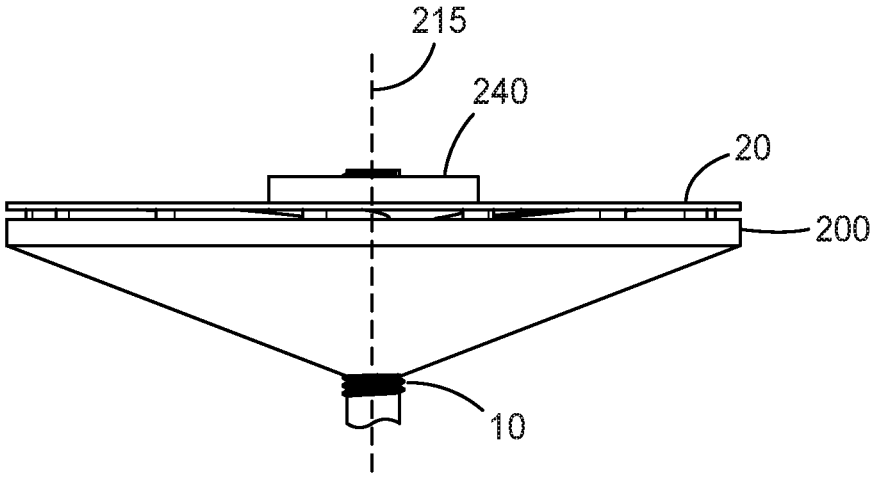
FIG. 7 is a schematic side view of repositionable abrasive disc mounting assembly 200 retaining an abrasive disc and mounted on a drive shaft of a power tool.
Figure 8:
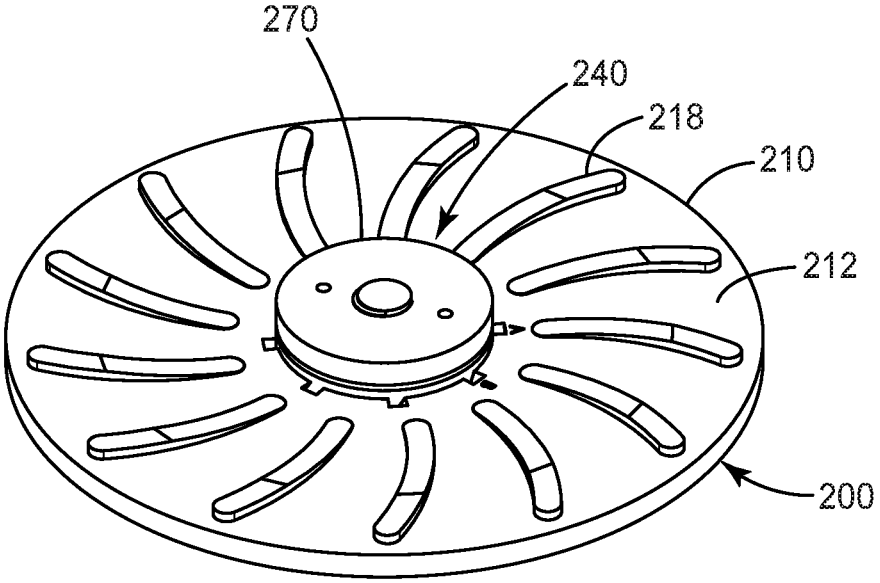
FIG. 8 is a schematic perspective view of repositionable abrasive disc mounting assembly 200.

A second embodiment of a repositionable abrasive disc mounting assembly 200 is shown FIGS. 6 to 10. Referring now to FIGS. 6-8, repositionable abrasive disc mounting assembly 200 comprises a backup pad 210 and a clamp assembly 240 that secures an abrasive disc 20. Repositionable abrasive disc mounting assembly 200 includes a threaded bore fastener member 230 (see FIG. 9) that is adapted to engage a threaded drive shaft 10 of a power tool (not shown) such as, for example, an angle grinder. The backup pad has ribbed projections 218 (see FIG. 8) that added provide support to abrasive disc 20. During abrading of a workpiece, the drive shaft 10 rotates around a rotational axis of use (215).

Figure 9:
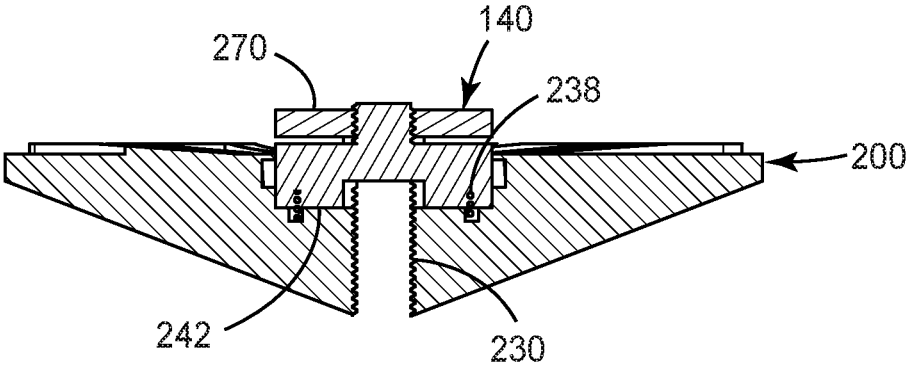
FIG. 9 is a schematic side view of repositionable abrasive disc mounting assembly 200.
Figure 10:
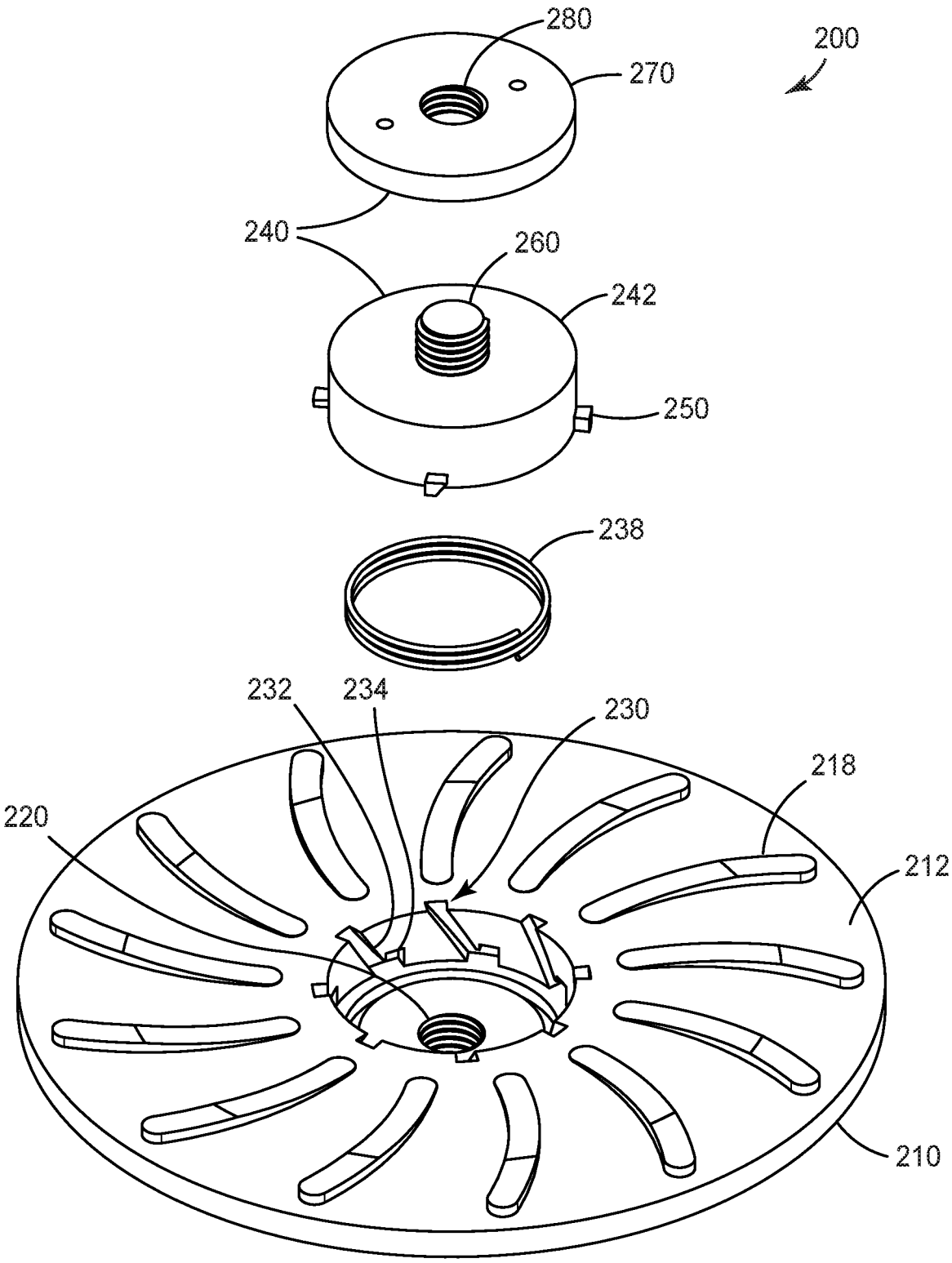
FIG. 10 is a schematic exploded perspective view of repositionable abrasive disc mounting assembly 200.

FIGS. 8-10 further show the repositionable abrasive disc mounting assembly 200 in isolation without an accompanying abrasive disc and threaded drive shaft.

Referring now to FIG. 10, repositionable abrasive disc mounting assembly 200 comprises a backup pad 210. Backup pad 210 has a rotational axis of use (see 215 in FIG. 7) and a major surface 212 with ribbed projections 218 extending outwardly therefrom. Backup pad 210 comprises an inwardly facing centrally disposed first fastening member 220 (shown as a threaded bore) for securing the backup pad 210 to a drive shaft of a power tool (see 10 in FIG. 7). Backup pad 210 further comprises an outwardly facing centrally disposed second fastening member 230 (shown as helical grooves 232 connected to locking slots 234).

Clamp assembly 240 comprises inner and outer clamp members (242, 270).

Inner clamp member 242 comprises an inwardly facing centrally disposed third fastening member 250 (shown as pins) adapted to repositionably engage the second fastening member 230 and, when fully engaged, lock in place as the pins are urged into locking slots 234 by compressed spring 238. The spacing and pitch of the helical grooves 232 provides discrete rotational orientations at which the clamp assembly 240 can be secured. Inner clamp member 242 further comprises an outwardly facing centrally disposed fourth fastening member 260 (shown as a threaded post).

Outer clamp member 270 comprises an inwardly facing centrally disposed fifth fastening member 280 (shown as a threaded bore) adapted to securely engage the threaded post 260.

In this configuration, the clamp assembly is locked in placed, but is easily removed by pushing inwardly against the clamp assembly while turning it to place it in the unlocked position. The clamp assembly is then disengaged from the backup pad by a simple twisting motion, and can then be rotated to a new orientation and reengaged with the backup pad.

Other configurations may be also be used provided that the clamp assembly is repositionable in discrete rotational orientations, that do not place the protrusions of the backup member against the same worn portions of the abrasive disc. That is, the permit rotation of the abrasive disc relative to the backup member so that less worn portions of the abrasive layer are adjacent to the protrusions.

In practice of methods according to the present disclosure, repositioning of the abrasive disc relative to the raised projection of the backup pad may be repeated any desired number of times. The methods may be practiced manually, automatically, robotically, or a combination thereof.

The preceding description, given in order to enable one of ordinary skill in the art to practice the claimed disclosure, is not to be construed as limiting the scope of the disclosure, which is defined by the claims and all equivalents thereto.

What is claimed is:

1. A repositionable abrasive disc mounting assembly comprising:

a backup pad having a rotational axis of use and a major surface with projections extending outwardly therefrom, wherein the backup pad further comprises an inwardly facing centrally disposed first fastening member for securing the backup pad to a drive shaft of a power tool, and wherein the backup pad further comprises an outwardly facing centrally disposed second fastening member; and a clamp assembly configured to secure an abrasive disc, the clamp assembly comprising inner and outer clamp members, wherein the inner clamp member comprises an inwardly facing centrally disposed third fastening member adapted to repositionably engage the second fastening member in a discrete number of rotational orientations around the rotational axis of use, and wherein the inner clamp member further comprises an outwardly facing centrally disposed fourth fastening member, wherein the clamp assembly is repositionable in discrete rotational orientations that do not place the protrusions of the backup member against the same worn portions of the abrasive disc, and wherein the outer clamp member comprises an inwardly facing centrally disposed fifth fastening member adapted to securely engage the fourth fastening member, wherein the third fastening member comprises fewer engagement features than the second fastening member.

2. The repositionable abrasive disc mounting assembly of claim 1, wherein the outwardly facing centrally disposed second fastening member and the inwardly facing centrally disposed third fastening member are capable of engaging each other in a releasably locked position.

3. The repositionable abrasive disc mounting assembly of claim 1, wherein the inwardly facing centrally disposed third fastening member comprises a plurality of pins.

4. The repositionable abrasive disc mounting assembly of claim 1, wherein the inwardly facing centrally disposed third fastening member comprises a plurality of helical ribs.

5. The repositionable abrasive disc mounting assembly of claim 1, wherein the projections comprise arcuate ribs.

6. A method of abrading a workpiece using the repositionable abrasive disc mounting assembly of claim 1, the method comprising the steps:

a) mounting the backup pad on the drive shaft of the power tool, wherein the outwardly facing projections are capable of contacting the abrasive disc when abrading the work;

b) securing the abrasive disc to the backup pad via the clamp assembly;

c) abrading the workpiece with the abrasive disc whereby more worn and less worn regions of the abrasive disc are formed;

d) repositioning the abrasive disc relative to the backup pad such that the outwardly facing projections of the backup pad are predominantly rotationally aligned with the less worn regions; and e) abrading at least one of the same or a different workpiece.

7. The method of claim 6, wherein the method is at least partially robotically performed.

8. The method of claim 6, wherein the method is manually performed.

9. The method of claim 6, wherein step e) comprises abrading the same workpiece.

10. The method of claim 6, further comprising repeating at least step d) after step e).

* * * * *